US005342163A

United States Patent [19]

Yost

[11] Patent Number: 5,342,163

[45] Date of Patent: Aug. 30, 1994

[54] DRUM GRASPING DEVICE

[75] Inventor: Garnet R. Yost, Alberta, Canada

[73] Assignee: Chemonics Industries, Inc., Phoenix, Ariz.

[21] Appl. No.: 22,694

[22] Filed: Mar. 1, 1993

[51] Int. Cl.[5] ..... B66F 9/18

[52] U.S. Cl. ..... 414/607; 294/90; 414/622

[58] Field of Search ..... 414/621, 622, 450–456, 414/607; 294/90, 103.1

[56] References Cited

U.S. PATENT DOCUMENTS

| | | | |
|---|---|---|---|
| 2,272,447 | 2/1942 | Traxel | 414/450 X |
| 2,689,663 | 9/1954 | Shramek | 414/621 |
| 2,693,289 | 11/1954 | Ulinski | 414/621 |
| 2,698,107 | 12/1954 | Ericson | 414/621 |
| 3,042,241 | 7/1962 | Bauman | 414/621 |
| 4,029,230 | 6/1977 | Bolduc et al. | 414/622 |
| 4,130,212 | 12/1978 | Gatilao | 414/607 X |
| 4,243,354 | 1/1981 | Garcia | 294/90 X |
| 4,685,713 | 8/1987 | Van der Hulst et al. | 294/90 |
| 4,741,659 | 5/1988 | Berg | 414/622 X |
| 5,122,027 | 6/1992 | Tabayashi | 414/622 |

FOREIGN PATENT DOCUMENTS

| | | | |
|---|---|---|---|
| 1025336 | 2/1958 | Fed. Rep. of Germany | 414/621 |
| 1382809 | 3/1988 | U.S.S.R. | 294/90 |

*Primary Examiner*—David A. Bucci
*Attorney, Agent, or Firm*—William H. Drummond

[57] ABSTRACT

A device, adaptable to a forklift, for grasping a storage drum by a lip formed in its top edge. A lifting arm supports the lip from below while a mechanical linkage causes the spring-loaded support arm to be drawn against the inside surface of the lip as the device is raised by the forklift. Further lifting by the forklift causes the drum to be raised while the force exerted by the holding arm against the lip is dictated by the weight of the drum. Lowering the drum to the ground causes the mechanism to automatically release.

6 Claims, 4 Drawing Sheets

DRUM GRASPING DEVICE

BACKGROUND OF THE INVENTION

1. Field of the Invention

The present invention generally relates to storage drum handling equipment and more particularly pertains to devices for grasping a drum to allow it to be lifted and moved as by for example a forklift.

2. Description of the Related Art

The shape and bulk of storage drums has typically posed a substantial problem for the mechanical manipulation thereof, especially by for example a forklift. Although a forklift has ready access to a drum once it is placed on a pallet, initially placing the drum on a pallet usually requires a substantial amount of manual effort, especially when heavy. And while it is also possible to use the forks of a forklift to directly grasp a drum just below the ribs typically formed on its exterior surface, such technique is not an altogether practical solution. A precise alignment of the forks and careful maneuvering of the forklift is required to avoid crushing or dropping the drum and such technique cannot be employed when the drum is very heavy.

Relatively complex, hydraulically actuated specialized mechanisms have been devised for fitment to a forklift which allow for a drum to be grasped about its circumference. Such devices are however very complex and expensive and are not readily connected to and disconnected from a forklift. A forklift so fitted is typically committed to drum handling only.

The prior art is devoid of a device that is quickly attachable to a forklift, that is simple and relatively inexpensive and that allows a drum to be quickly, automatically and securely grasped and easily released.

SUMMARY OF THE INVENTION

The present invention provides a simple device for grasping storage drums. The device's function is automatic, requiring no manual intervention in order to perform its function. Its function is completely mechanical, no hydraulic or electric actuators are employed. Moreover, the weight of the drum automatically determines how tightly it is grasped.

The type of drum the device of the present invention is capable of grasping has a lip formed about its top edge which projects both radially outwardly and axially upwardly. The device when fitted to a forklift requires the operator to merely position the vehicle such that the device's lifting arm engages the outwardly projecting lip from below. The load bearing down on the lift arm as the forks are raised causes a holding arm to shift toward and engage the inner surface of the upwardly projecting lip. This serves to securely trap the lip and allows the entire drum to be lifted thereby.

More specifically, the device of the present invention provides a head assembly that is slidably supported along a vertical support member. The sliding assembly includes a lifting arm that is fixed relative the head assembly and a holding arm that is shiftable relative the head assembly along a horizontal plane. A mechanism links the horizontal position of the holding arm with the vertical position of the entire head assembly. The further the head assembly is shifted downwardly along the support member by the weight of the drum bearing down on the lifting arm via the outwardly protruding portion of the drum's lip, the further the holding arm is drawn inwardly toward the head assembly to thereby engage the upwardly projecting portion of the drum's lip. Compression springs bias the holding arm away from the head assembly and hence also serve to bias the entire head assembly upwardly.

These and other features and advantages of the present invention will become apparent from the following detailed description of a preferred embodiment which, taken in conjunction with the accompanying drawings, illustrates by way of example the principles of the invention.

DETAILED DESCRIPTION OF A PREFERRED EMBODIMENT

Figure 1:
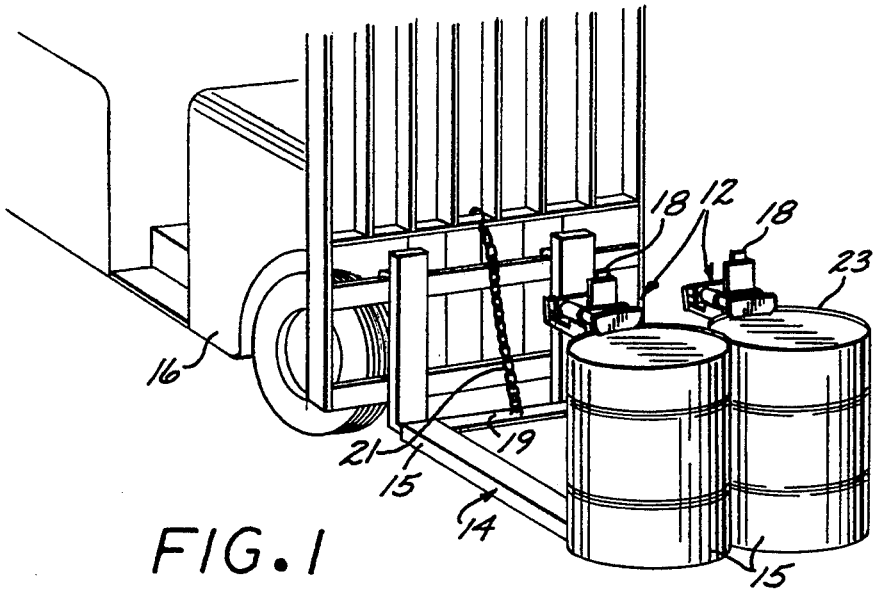
FIG. 1 is a perspective view of grasping mechanisms of the present invention fitted to a forklift.

FIG. 1 generally illustrates a grasping device 12 according to the present invention and more particularly shows two such devices fitted to a frame 14 that is readily accessed by a forklift 16. Maneuvering the forklift and adjusting the height of the forks such that the devices 12 are positioned adjacent drums 50 allows the drums to be lifted and moved simply by raising the forks.

Frame 14 includes two box-section horizontal support members 15 dimensioned to receive the forks of a forklift. Rising from the distal end of the horizontal support members are two vertical support members 18. Cross member 19 and triangular braces 17 serve to strengthen the structure. Safety chain 21 is affixed to cross member 19 and is attachable to the forklift. Lower drum supports 25 are rigidly affixed to the base of the front of frame 14 and are curved to conform to the curvature of a drum.

Figure 2:
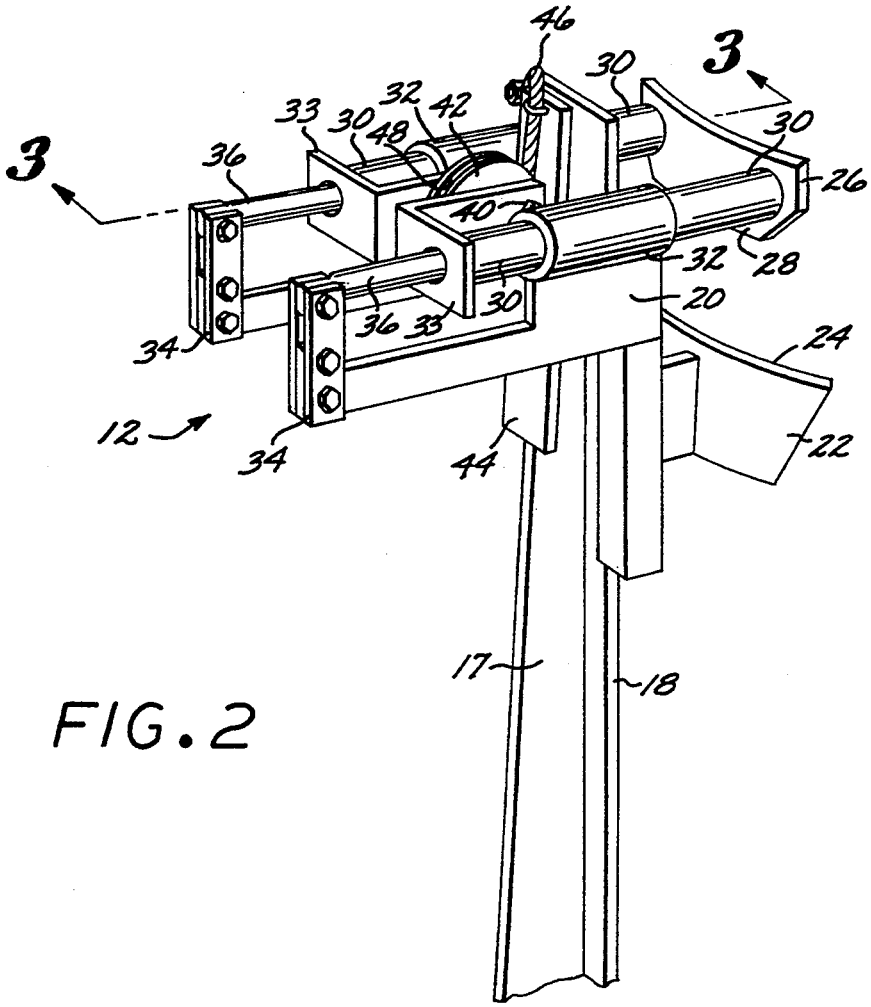
FIG. 2 is an enlarged perspective view of the grasping mechanism.
Figure 3:
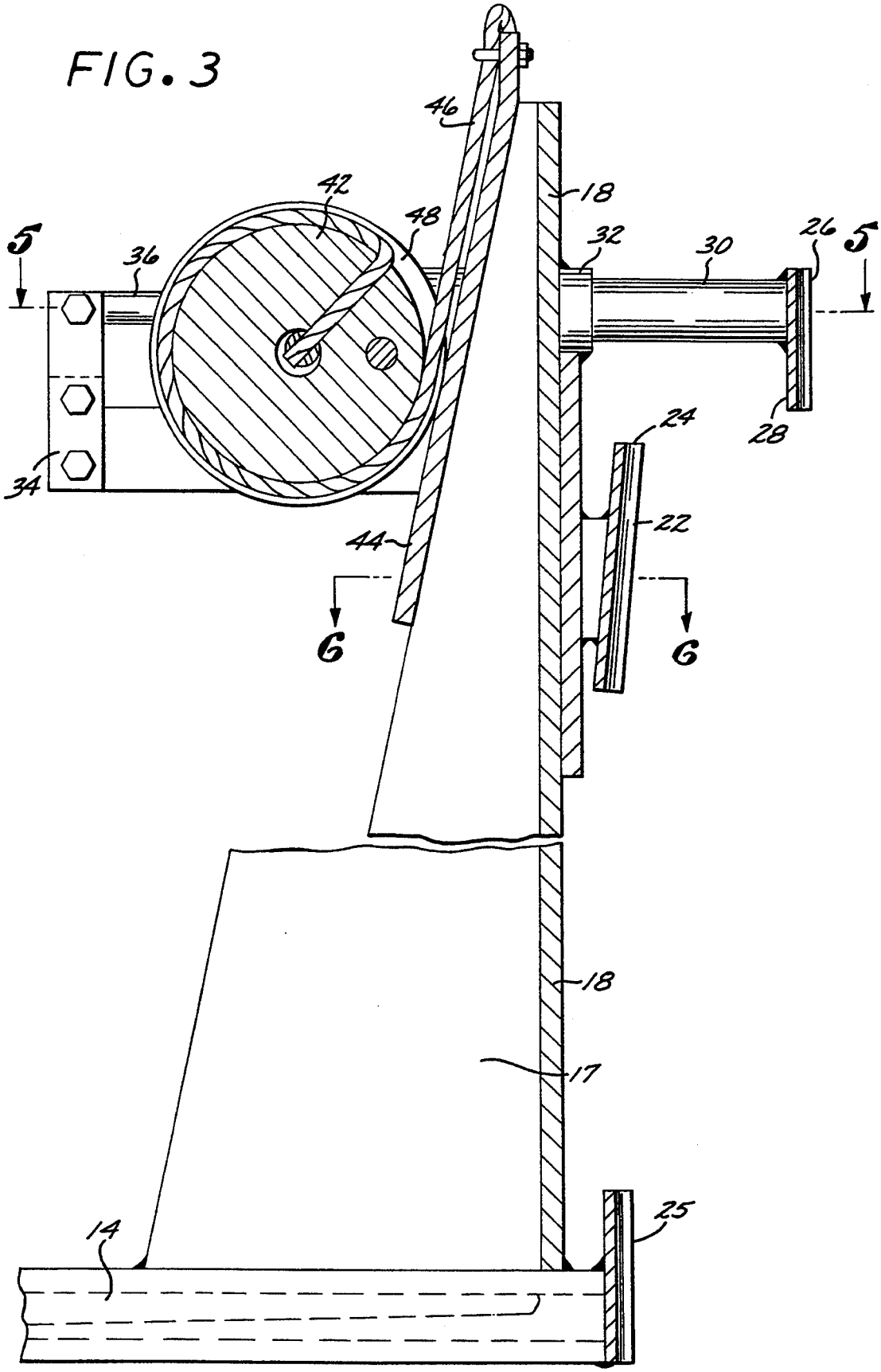
FIG. 3 is an enlarged cross-sectional view of the grasping mechanism in its unloaded position taken along lines 3—3 of FIG. 2.
Figure 4:
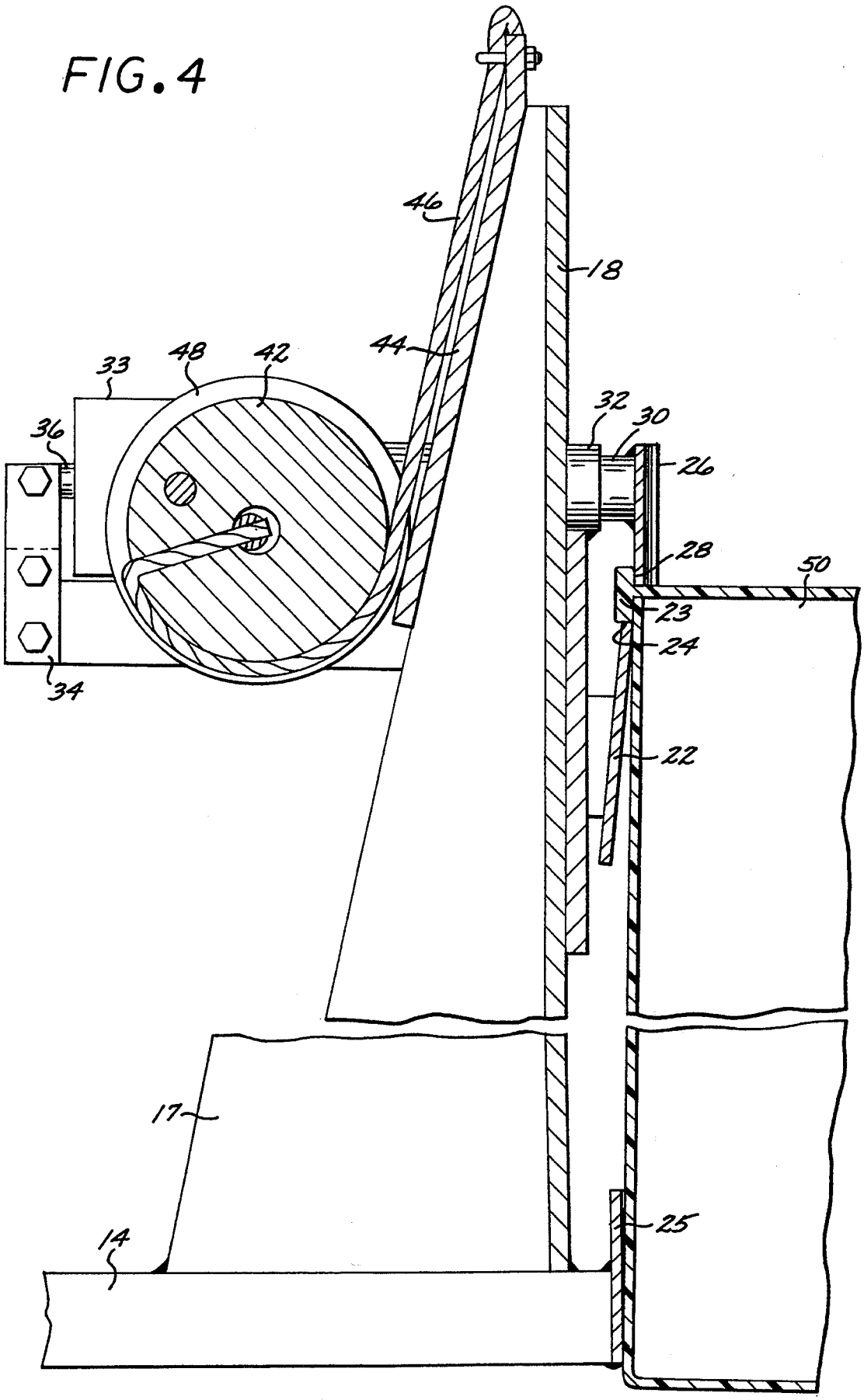
FIG. 4 is an enlarged cross-sectional view of the grasping mechanism in its loaded position.
Figure 5:
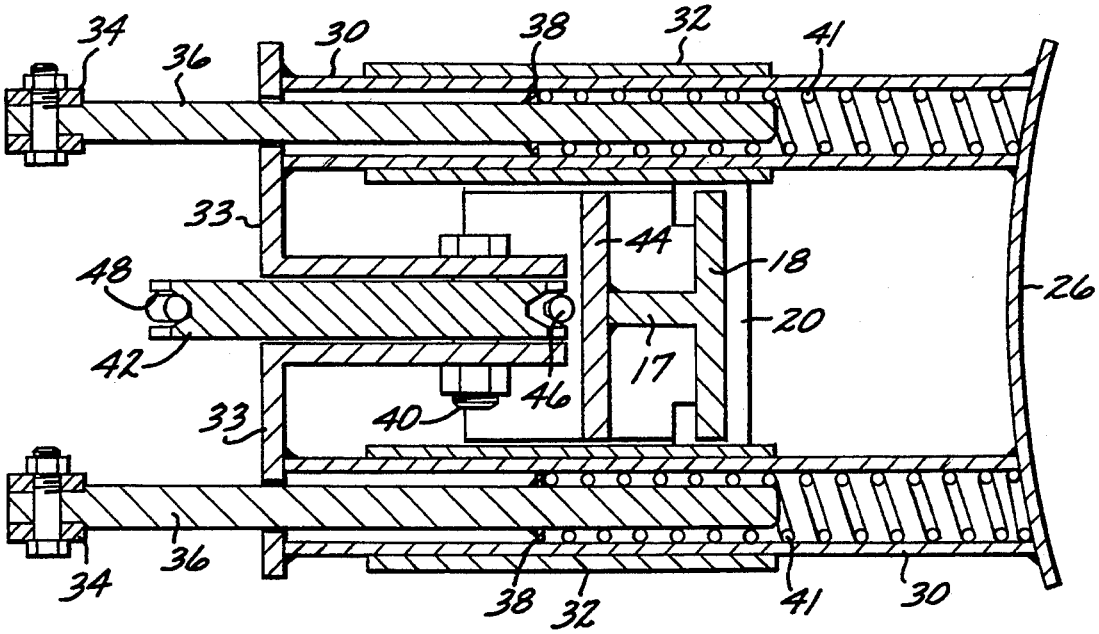
FIG. 5 is an enlarged cross-sectional view taken along lines 5—5 of FIG. 3.
Figure 6:
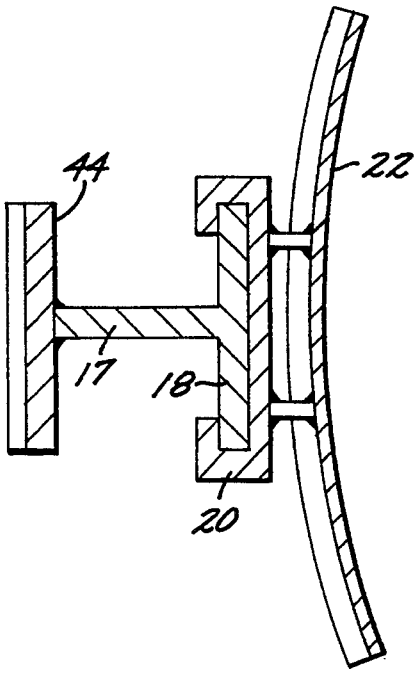
FIG. 6 is an enlarged cross-sectional view taken along lines 6—6 of FIG. 3.

FIG. 2 is an enlarged view of one of the grasping devices 12 of the present invention. The grasping device includes a head assembly 20 that is slidably disposed about support member 18 such that its position is adjustable along the vertical. Rigidly attached to the head assembly is lifting arm 22. The lifting arm has an upper load bearing edge 24 which is tilted slightly forwardly and is generally curved to conform to the curvature of the type of drum 15 to be manipulated. The head assembly 20 further includes a holding arm 26. The holding arm has a lower load bearing edge 28 and is also curved to conform to the curvature of a drum. Two connecting tubes 30 rigidly connected to the holding arm are slidingly received within and extend completely through tubular housings 32. The proximal ends of connecting tubes 30 are rigidly secured to brackets 33 that position an axle shaft 40 extending therebetween. Brackets 34 affixed to the assembly head 20 serve to position rods 36 which in turn extend into the interior of connecting tubes 30. FIG. 5 shows a spring seat 38 disposed on each rod 36 which serves to constrain a compression spring 41 between it and the distal end of the connecting tube 30 and thereby serves to bias the holding arm 26 outwardly away from the head assembly 20.

The axle shaft 40 rotatably supports pulley wheel 42. The pulley wheel is of sufficient size to engage ramp 44 affixed to the back edge of triangular brace 17. The pulley is eccentrically mounted and has a cable 46 fastened thereto that is wound about a groove 48 formed about the pulley wheel's circumference and extends upwardly to near the top of vertical support member 18 to which it is rigidly secured. The horizontal position of the holding arm 26 is thereby mechanically linked to the vertical position of the head assembly 20 relative support member 18. Springs 41 bias the holding arm 26 outwardly away from the head assembly 20 and simultaneously thereby serve to bias the entire head assembly 20 upwardly along vertical support 18.

In operation, the frame 14 carrying the grasping devices 12 is quickly and easily attached to a forklift 16 by simply inserting its forks into the box-section horizontal support members 15. The safety chain 19 is hooked to the forklift to prevent accidental separation of the frame 14 therefrom. The forklift carrying the frame is subsequently maneuvered into position relative the drum 15 to be moved so that the lifting arm 22 abuts the side of the drum 50 and its load bearing edge 24 is positioned just below the radially extending portion of lip 23.

Prior to loading the load bearing edge 24 of the lifting arm 22, compression springs 41 serve to maintain the entire head assembly 20 near the top of the vertical support 18 and additionally serve to maximize the extension of the holding arm 26 away from the head assembly. This position allows the lip 23 of the drum 15 to be readily accessed by the lifting arm 22.

As the forks are lifted, the weight of the drum bears down on the lifting arm 22 which causes the head assembly 20 to be shifted downwardly along vertical support member 18. As the head assembly 20 shifts downwardly, the pulley wheel 42 rotates relative the ramp 44. The angling of the ramp away from the vertical support 18 causes the holding arm 26 to be drawn inwardly via the connecting tubes 30 while compressing the springs 41 contained therein. The eccentricity of the pulley wheel 41 serves to amplify the horizontal movement of the holding arm 26 relative the vertical movement of the head assembly 20. The holding arm 26 eventually engages the lip 23 of the drum 50 as the load is increased at which time the full length of the cable 46 has been unwound from the pulley 42 and the full load is carried thereby. Further lifting of the forks causes the drum 50 to be lifted by the lifting arm 22 while the force exerted by the holding arm 26 against the drum's lip 23 holds the drum securely in place.

When the drum is set down, the opposite sequence of events occurs. As the forks are lowered and the drum 15 comes to rest, the force exerted by the compressed springs 41 causes the head assembly 20 to slide upwardly along the vertical support 18, the pulley wheel 42 rewinds the cable 46 and the holding arm 26 moves away from the lip 23 to release the drum 50.

While a particular form of the invention has been illustrated and described, it will also be apparent to those skilled in the art that various modifications can be made without departing from the spirit and scope of the invention. More particularly, it is not intended that the device of the invention be exclusively adapted to forklifts or that its use is to be limited to drums in view of the fact that any lipped object can be grasped thereby. Accordingly, it is not intended that the invention be limited except by the appended claims.

What is claimed is:

1. A device for grasping a storage drum having disposed near its top edge a circumferential lip that protrudes radially outwardly and axially upwardly, comprising:

a lifting arm for engaging the outwardly protruding portion of the lip from below and applying an upward lifting force thereto;

a holding arm for engaging the axially upwardly protruding portion of said lip from within; and a mechanism for shifting the holding arm toward the lip as a function of the force applied to the lip by the lifting arm;

said lifting arm being slidably disposed about a vertical support member having an upper end and wherein the position of the holding arm is shiftable relative the lifting arm on a horizontal plane, said lifting arm being biased upwardly along the vertical support member and said holding arm being biased away from the lifting arm; and said vertical support member including a surface that gradually diverges therefrom, and further comprising:

a guide member that is fixed with respect to the vertical position of the lifting arm, is directly linked to the horizontal position of the holding arm and that engages said diverging surface whereby the horizontal position of the holding arm is adjusted as a function of the vertical position of the lifting arm.

2. The device of claim 1 wherein said guide member comprises a rotatable wheel that rollingly engages said diverging surface, has a center of rotation that is fixed with respect to the vertical position of the lifting arm and is directly linked to the horizontal position of the holding arm.

3. The device of claim 2 wherein the lifting arm is supported by a cable having one end secured to the upper end of the vertical support member and its other end attached to the wheel and wherein a portion of said cable is wound around a portion of said wheel's circumference.

4. The device of claim 2 wherein said wheel's center of rotation is eccentrically located relative said wheel's circumference.

5. The device of claim 4 wherein the lifting arm is supported by a cable having one end secured to the upper end of the vertical support member and its other end attached to the wheel and wherein a portion of said cable is wound around a portion of said wheel's circumference.

6. The device of claim 5 wherein said vertical support is mounted on a frame that is readily picked up by a forklift.

* * * * *